US008289263B2

(12) United States Patent
Lee et al.

(10) Patent No.: US 8,289,263 B2
(45) Date of Patent: Oct. 16, 2012

(54) LED DRIVING APPARATUS AND LIQUID CRYSTAL DISPLAY APPARATUS USING THE SAME

(75) Inventors: Seok Woo Lee, Seoul (KR); Byoung Chul Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1048 days.

(21) Appl. No.: 11/646,719

(22) Filed: Dec. 27, 2006

(65) Prior Publication Data

US 2008/0088571 A1 Apr. 17, 2008

(30) Foreign Application Priority Data

Oct. 16, 2006 (KR) ..... 10-2006-0100408

(51) Int. Cl.
*G09G 3/36* (2006.01)
*G09G 3/32* (2006.01)

(52) U.S. Cl. ..... 345/102; 345/82

(58) Field of Classification Search ..... 345/102, 345/76–83; 315/297, 307–308; 327/94; 341/122
See application file for complete search history.

(56) References Cited

U.S. PATENT DOCUMENTS 6,844,760 B2 * 1/2005 Koharagi et al. ..... 327/110
7,202,608 B2 * 4/2007 Robinson et al. ..... 315/224
2003/0071606 A1 * 4/2003 Sunter ..... 324/76.15
2004/0100439 A1 * 5/2004 Chao ..... 345/102
2006/0082412 A1 * 4/2006 D'Angelo et al. ..... 327/541
2006/0146000 A1 * 7/2006 Choi ..... 345/100
2007/0114951 A1 * 5/2007 Tsen et al. ..... 315/291
2008/0054951 A1 * 3/2008 Singh et al. ..... 327/94
2008/0088571 A1 * 4/2008 Lee et al. ..... 345/102

* cited by examiner

*Primary Examiner* — Amr Awad
*Assistant Examiner* — Stephen Bray
(74) *Attorney, Agent, or Firm* — Brinks Hofer Gilson & Lione

(57) ABSTRACT

There are provided a LED driving apparatus and a liquid crystal display apparatus using the same, in which a circuit configuration of the LED driving apparatus can be simplified and the cost of the LED driving apparatus can be saved in employing a LED as a light source of the liquid crystal display apparatus. The LED driving apparatus comprises a plurality of n LED lamps, constant voltage providing units that provide constant voltages to the plurality of LED lamps, respectively, a Pulse Width Modulation (PWM) control signal providing unit that provides PWM signals to the constant voltage providing units, respectively, and a feedback control unit that receives voltages feedbacked through the plurality of LED lamps, compensating for the voltages as constant voltages suitable for constant current driving of each of the LED lamps, and sequentially outputs the constant voltages to the constant voltage providing units, respectively, based on time-dividing.

8 Claims, 5 Drawing Sheets

[Feedback Signal Sampling Sequence] [Compensation Signal Output Sequence]

LED DRIVING APPARATUS AND LIQUID CRYSTAL DISPLAY APPARATUS USING THE SAME

This nonprovisional application claims priority under 35 U.S.C. §119(a) on Patent Application No. 2006-0100408 filed in Republic of Korea on Oct. 16, 2006, the entire contents of which are hereby incorporated by reference.

BACKGROUND OF THE INVENTION

1. Field of the Invention

The present invention relates, in general, to a liquid crystal display apparatus. More particularly, the present invention relates to a Light-Emitting Diode (LED) driving apparatus for driving a LED when it is used as a light source of a liquid crystal display apparatus, and a liquid crystal display apparatus using the same.

2. Discussion of Related Art

In general, a liquid crystal display apparatus is a display apparatus, in which a liquid crystal layer having an anisotropic dielectric constant is formed between front and rear substrates (that is, transparent insulating substrates), and molecular arrangements of a liquid crystal material are changed by controlling the intensity of an electric field formed in the liquid crystal layer. Thus, a desired image is displayed depending on the amount of light transmitting to the front plate (that is, a display surface).

The liquid crystal display apparatus is a light-receiving type display apparatus that does not emit light itself, and thus requires a backlight disposed on a rear surface of a liquid crystal panel on which an image is displayed and serving to uniformly maintain the brightness of the whole screen.

A light source of the backlight for the liquid crystal display apparatus comprises a Cold Cathode Fluorescent Lamp (CCFL), an External Electrode Fluorescent Lamp (EEFL) or the like. Recently, a LED lamp has been in the spotlight as a next-generation light source, which has an excellent energy saving effect compared with the CCFL or EEFL and can be used semi-permanently.

The LED has usually been used for the light source of a backlight for a small-sized liquid crystal display apparatus, such as mobile phones. However, as the luminance of the LED is enhanced, the utilization range of the LED gradually expands to the light source of a backlight for a large-sized liquid crystal display apparatus.

A LED for a backlight of a conventional liquid crystal display apparatus and a driving apparatus thereof will be described below.

FIG. 1 is a view illustrating a conventional LED driving apparatus.

As illustrated in FIG. 1, the driving apparatus of the LED for the backlight of the conventional liquid crystal display apparatus comprises a plurality of LEDs LED11 to LED13, LED21 to LED23, and LED31 to LED33, LED drivers 10, 20 and 30 for driving the plurality of LEDs LED11 to LED13, LED21 to LED23, and LED31 to LED33, respectively, and DC-DC converter units 12, 22 and 32 for supplying constant voltages to the plurality of LEDs LED11 to LED13, LED21 to LED23, and LED31 to LED33, respectively.

The driving apparatus of the LED for the backlight of the conventional liquid crystal display apparatus further comprises feedback control units 14, 24 and 34 for controlling voltages feedbacked from the LEDs LED11 to LED13, LED21 to LED23, and LED31 to LED33 via the DC-DC converter units 12, 22 and 32, respectively, and Pulse Width Modulation (PWM) control signals providing unit 40 for providing a PWM control signal to the LED drivers 10, 20 and 30.

The PWM control signals serve to convert constant voltages, suitable for constant current driving of the LEDs LED11 to LED13, LED21 to LED23, and LED31 to LED33, into widths of waveforms, and control the converted waveforms.

The plurality of LEDs LED11 to LED13, LED21 to LED23, and LED31 to LED33 may be divided depending on the region of the backlight and then grouped, thereby forming a plurality of LED lamps G10, G20 and G30, respectively.

As described above, the conventional LED driving apparatus comprises the LED drivers 10, 20 and 30 and the feedback control units 14, 24 and 34 every LED lamps G10, G20 and G30 in order to independently control the luminance of the backlight region.

Accordingly, in order to construct the conventional LED driving apparatus, the LED drivers 10, 20 and 30 and the feedback control units 14, 24 and 34 must be respectively provided in proportion to the number of the divided backlight regions. Therefore, problems arise because the number of electronic elements necessary to construct the LED driving apparatus increases, and the cost for a driving circuit of the LED rises accordingly.

Furthermore, the size of the whole driving circuit of the LED increases. Also, the wiring structure of a Printed Circuit Board (PCB) in which the driving circuit of the LED is mounted becomes complicated.

SUMMARY OF THE INVENTION

Accordingly, an object of the present invention is to solve at least the problems and disadvantages of the background art.

A LED driving apparatus comprises a plurality of n LED lamps in which LEDs are connected in series. Constant voltage providing units provide constant voltages to the plurality of LED lamps, respectively. A PWM control signal providing unit provides PWM signals to the constant voltage providing units, respectively. A feedback control unit receives voltages feedbacked through the plurality of LED lamps, compensating for the voltages as constant voltages suitable for constant current driving of each of the LED lamps, and sequentially outputs the constant voltages to the constant voltage providing units, respectively, based on time-dividing.

A liquid crystal display apparatus according to an embodiment of the present invention comprises a liquid crystal panel, and a LED driving apparatus that illuminates the liquid crystal panel from the rear of the liquid crystal panel. The LED driving apparatus comprises a plurality of n LED lamps in which LEDs that provide light to the liquid crystal panel are connected in series. Constant voltage providing units provide constant voltages to the plurality of LED lamps, respectively A PWM control signal providing unit provides PWM signals to the constant voltage providing units, respectively A feedback control unit receives voltages feedbacked through the plurality of LED lamps, compensating for the voltages as constant voltages suitable for constant current driving of each of the LED lamps, and sequentially outputs the constant voltages to the constant voltage providing units, respectively, based on time-dividing.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Concrete items of other embodiments are included in the detailed description and drawings. Merits and characteristics of the invention, and methods for accomplishing them will become more apparent from the following embodiments taken in conjunction with the accompanying drawings. The same reference numbers will be used throughout the drawings to refer to the same or like parts.

A LED driving apparatus and a liquid crystal display apparatus using the same according to embodiments of the present invention will be described below in connection with specific embodiments with reference to the accompanying drawings.

Figure 1:
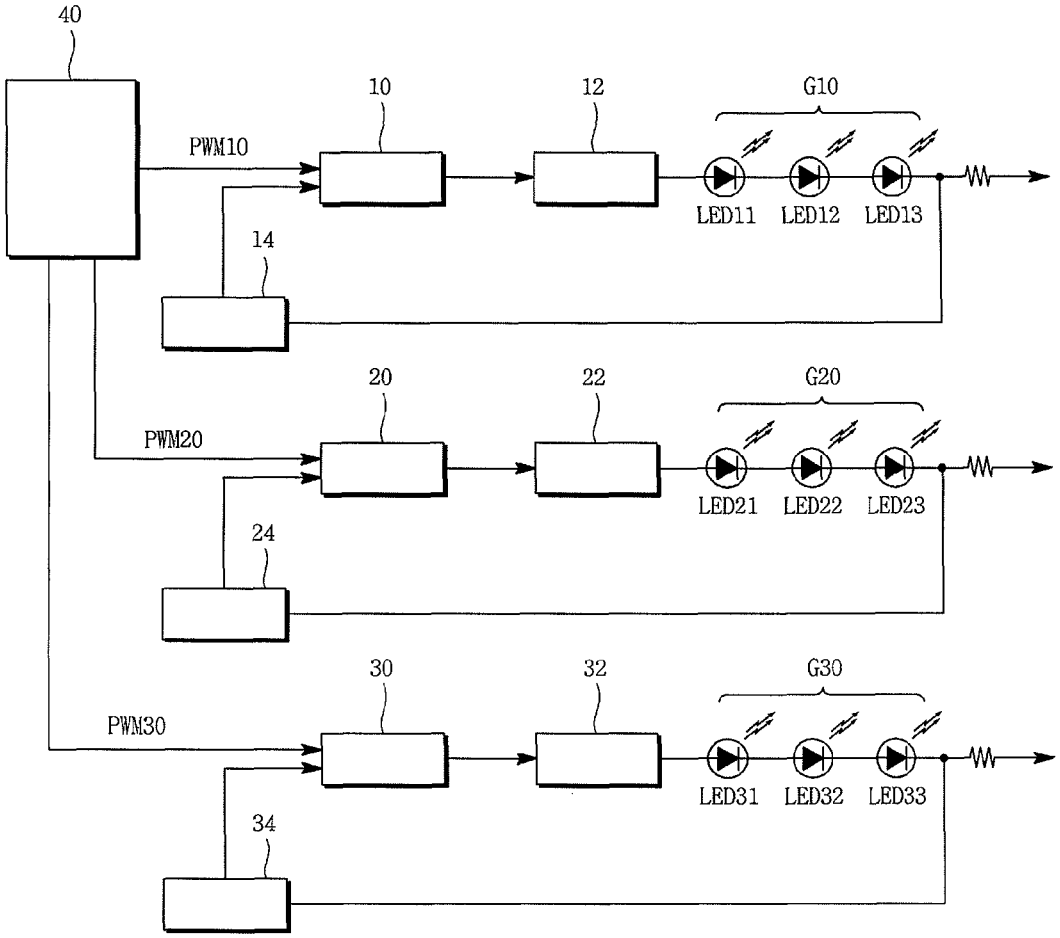
FIG. 1 RELATED ART
FIG. 1 is a view illustrating a conventional LED driving apparatus.
Figure 2:
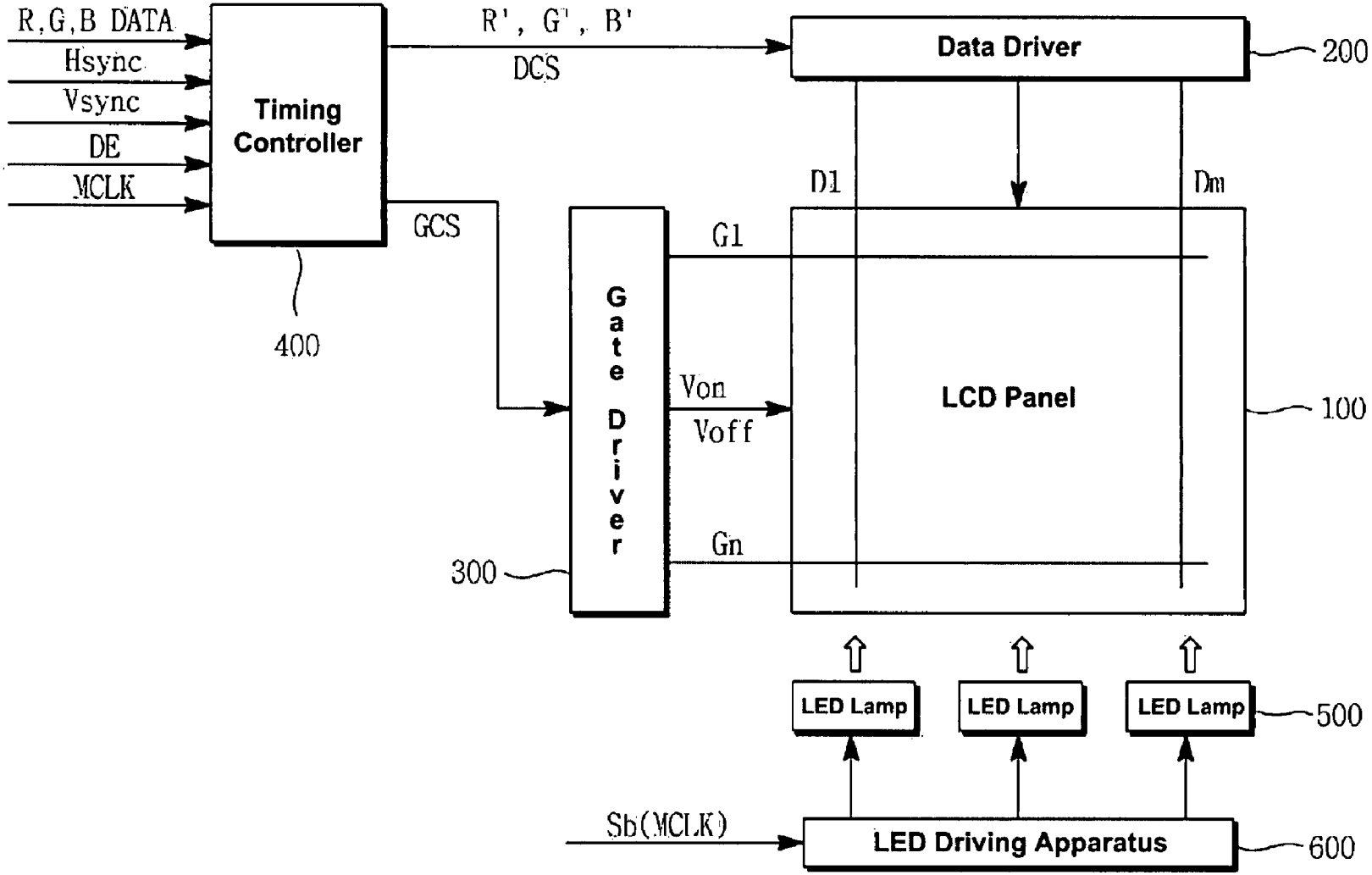
FIG. 2 is a block diagram schematically showing a driving circuit of a liquid crystal display apparatus according to an embodiment of the present invention.

FIG. 2 is a block diagram schematically showing a driving circuit of a liquid crystal display apparatus according to an embodiment of the present invention.

Referring to FIG. 2, the driving circuit of the liquid crystal display apparatus according to an embodiment of the present invention comprises a data driver 200 that drives data lines D1, . . . , Dm of a liquid crystal panel 100 on which an image is displayed, a gate driver 300 for driving gate lines G1, . . . , Gn of the liquid crystal panel 100, a timing controller 400 that applies a variety of control signals to the data driver 200 and the gate driver 300, and a LED driving apparatus 600 that provides light to the liquid crystal panel 100.

The timing controller 400 receives digital image signals R, G and B DATA, a horizontal sync signal Hsync, a vertical sync signal Vsync, a data application region signal DE and a main clock MCLK from the outside, and supplies control signals DCS and GCS to the data driver 200 and the gate driver 300, respectively.

The timing controller 400 transforms the externally input digital image signals R, G and B DATA and applies generated digital image signals R', G' and B' to the data driver 200.

The data application region signal DE is a signal indicating a region from which a data is output. The main clock MCLK is a reference clock signal and is received from a microprocessor.

The gate driver 300 applies a gate-off voltage Voff or a gate-on voltage Von to the gate lines G1 to Gn in response to the gate control signal GCS received from the timing controller 400, thus supplying scan signals that are sequentially shifted.

The data driver 200 generates analog gray level voltages corresponding to the digital image signals R', G' and B' in response to the data control signal DCS received from the timing controller 400.

When the gate lines G1, . . . , Gn that are turned off are turned on in response to the gate control signal GCS, the analog gray level voltages generated from the data driver 200 are applied to the data lines D1, . . . , Dm of the liquid crystal panel 100.

The LED driving apparatus 600 comprises a plurality of LED lamps (not shown) disposed at the rear of the liquid crystal panel 100 and configured to irradiate light to the liquid crystal panel 100. The LED driving apparatus 600 controls the lighting of the plurality of LED lamps 500 in response to a light source control signal Sb received from the external microprocessor, and also supplies a high voltage necessary for lighting.

The light source control signal Sb to control the LED driving apparatus 600 is generated through the main clock MCLK independently from the control signals DCS and GCS output from the timing controller 400.

The LED driving apparatus 600 according to an embodiment of the present invention will be described below in more detail.

Figure 3:
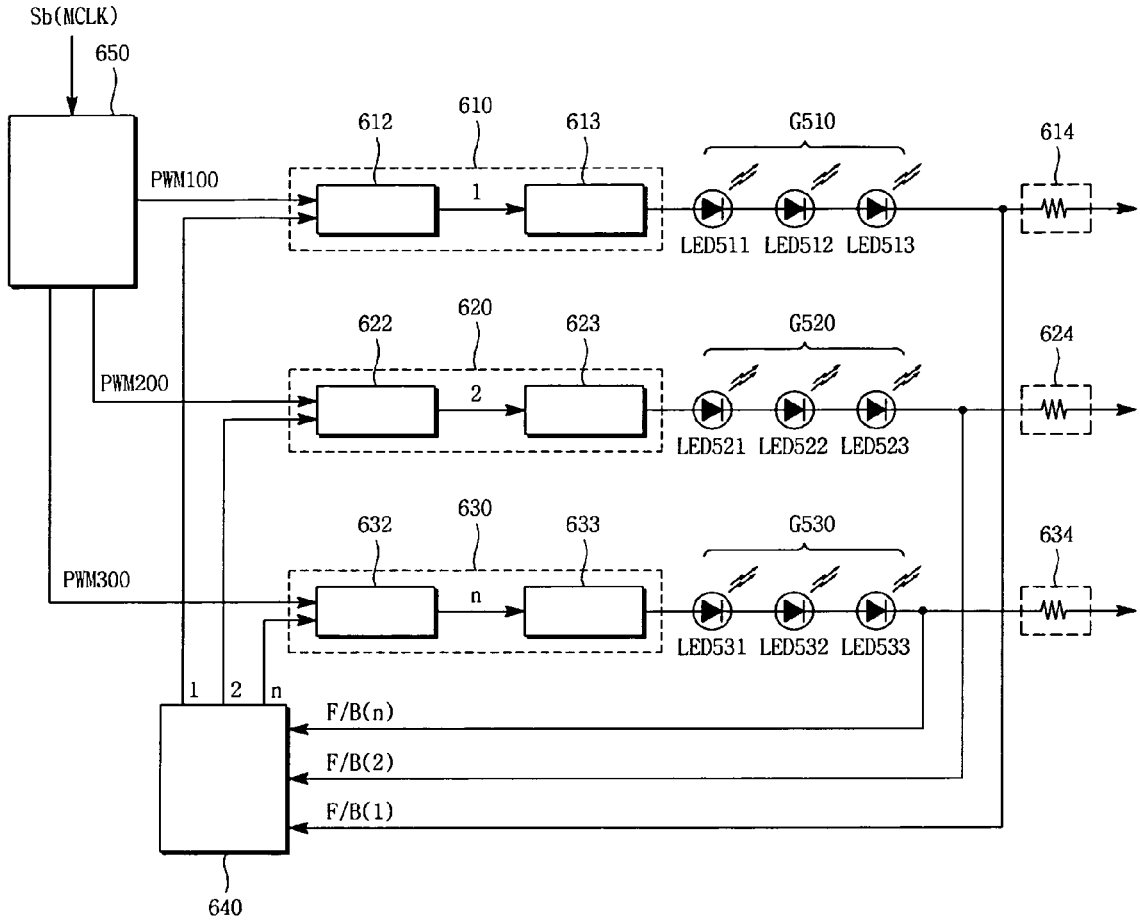
FIG. 3 is a view illustrating the construction of a LED driving apparatus according to an embodiment of the present invention.

FIG. 3 is a view illustrating the construction of the LED driving apparatus according to an embodiment of the present invention.

As illustrated in FIG. 3, the LED driving apparatus comprises LED lamps G510, G520 and G530 comprising a plurality of LEDs LED511 to LED513, LED521 to LED523, and LED531 to LED533, respectively, constant voltage providing units 610, 620 and 630, a feedback control unit 640, and a PWM control signal providing unit 650.

The LED driving apparatus may further comprise a plurality of resistors 614, 624 and 634 electrically connected to the rear ends of the LED lamps G510, G520 and G530, respectively.

The plurality of resistors 614, 624 and 634 function to limit or detect currents that have passed through the LED lamps G510, G520 and G530.

The LED driving apparatus constructed above supplies a high voltage necessary for lighting to turn on the LED lamps G510, G520 and G530, at the time of an initial lighting of the LED lamps G510, G520, and G530, and controls the currents of the LED lamps G510, G520 and G530 to maintain a constant brightness, after the lighting.

The plurality of n LED lamps G510, G520 and G530 are classified on a backlight-region basis. The LED lamps G510, G520 and G530 comprise the plurality of LEDs LED511 to LED513, LED521 to LED523, and LED531 to LED533, respectively, which are connected in series and grouped.

The LED lamps G510, G520 and G530 are constructed to cause light, supplied to the liquid crystal panel 100, to have white light. The LED lamps G510, G520 and G530 may be constructed to emit one color light of red R, green G, and blue B, if appropriate.

The constant voltage providing units 610, 620 and 630 function to provide constant voltages necessary to drive the plurality of LED lamps G510, G520 and G530, and they comprise LED drivers 612, 622 and 632, respectively, and DC-DC converter units 613, 623 and 633, respectively.

In particular, the LED drivers 612, 622 and 632 output control signals in response to a light source control signal Sb that is received from the outside, and control lighting times of the plurality of LEDs LED511 to LED513, LED521 to LED523, and LED531 to LED533.

The DC-DC converter units 613, 623 and 633 are electrically connected between the LED drivers 612, 622 and 632 and the LED lamps G510, G520 and G530, respectively, and boost input voltages so that constant voltages are supplied to the LED lamps G510, G520 and G530.

The DC-DC converter units 613, 623 and 633 may be provided separately from the LED drivers 612, 622 and 632, respectively, or may be built in the LED drivers 612, 622 and 632, respectively.

The DC-DC converter units 613, 623 and 633 and the LED drivers 612, 622 and 632 are provided corresponding to the plurality of n LED lamps G510, G520 and G530 one by one, as illustrated in the drawing.

For example, the first LED driver 612 may provide a constant voltage to the first LED lamp G510 via the first DC-DC converter unit 613. The second LED driver 622 may provide a constant voltage to the second LED lamp G520 via the second DC-DC converter unit 623. The third LED driver 632 may provide a constant voltage to the third LED lamp G530 via the third DC-DC converter unit 633.

The PWM control signal providing unit 650 is respectively connected to the constant voltage providing units 610, 620 and 630, and provides the control signal, received from the external microprocessor, to each of the LED drivers 612, 622 and 632.

In particular, the PWM control signal providing unit 650 generates PWM control signals PWM100, PWM200 and PWM300 for turning on or off driving currents every LED lamps G510, G520 and G530 in response to the light source control signal Sb received from the external microprocessor, and supplies the generated PWM control signals to the LED drivers 612, 622 and 632.

The PWM control signals PWM100, PWM200 and PWM300 may be applied to the LED lamps G510, G520 and G530 as the same signal or different signals.

For example, in the case where the plurality of LED lamps G510, G520 and G530 comprise only a white LED, the PWM control signal having the same waveform is supplied since a constant voltage necessary for driving is the same. In the case where the plurality of LED lamps G510, G520 and G530 comprise a red LED, a green LED and a blue LED respectively emitting the red, green and blue, the PWM control signals having different waveforms are supplied since constant voltages necessary for driving are different.

The feedback control unit 640 is electrically connected to the plurality of LED drivers 612, 622 and 632 and the plurality of LED lamps G510, G520 and G530. Accordingly, the feedback control unit 640 receives feedback voltages F/B(1), F/B(2), . . . , F/B(n) feedbacked via the LED lamps G510, G520 and G530, compensates for the feedback voltages F/B(1), F/B(2), . . . , F/B(n) as constant voltages suitable for constant current driving of the LED lamps G510, G520 and G530, and applies the compensated constant voltages to the LED drivers 612, 622 and 632, respectively.

The feedback control unit 640 sequentially processes the feedback voltages F/B(1), F/B(2), . . . , F/B(n), feedbacked in parallel from the LED lamps G510, G520 and G530, based on a predetermined time-dividing method. This will be described in more detail below.

The feedback control unit 640 is one in number regardless of the number of the plurality of LED lamps G510, G520 and G530, and can integrally input and output the feedback voltages F/B(1), F/B(2), . . . , F/B(n) feedbacked from the plurality of LED lamps G510, G520 and G530.

Figure 4:
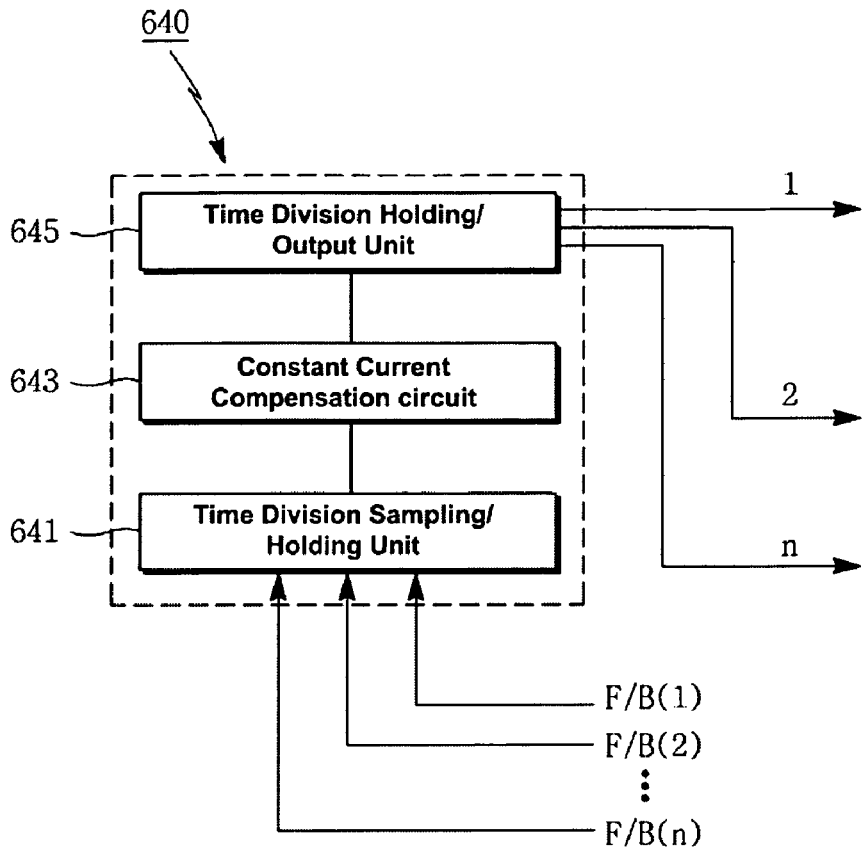
FIG. 4 shows a detailed construction of a feedback control unit in the LED driving apparatus according to an embodiment of the present invention.
Figure 5:
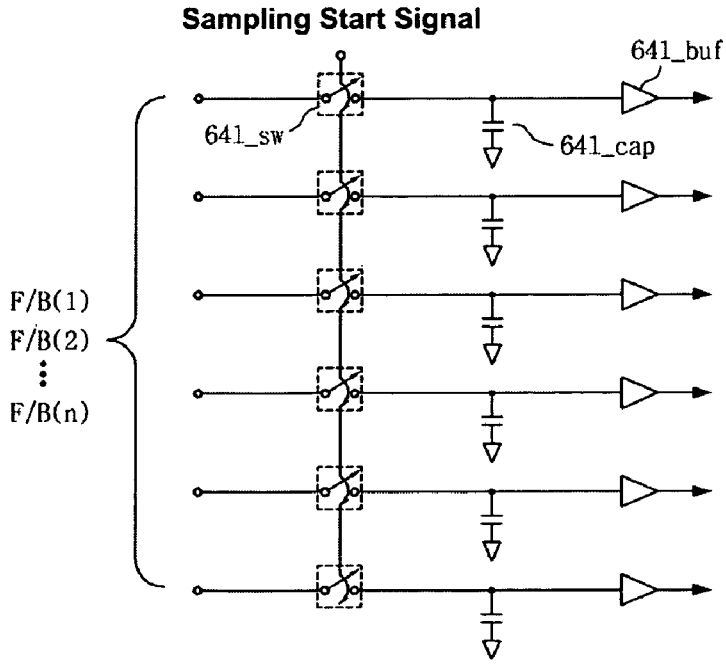
FIG. 5 is an equivalent circuit diagram schematically showing a time-dividing sampling/holding unit illustrated in FIG. 4.

FIG. 4 shows a detailed construction of a feedback control unit in the LED driving apparatus according to an embodiment of the present invention. FIG. 5 is an equivalent circuit diagram schematically showing a time-dividing sampling/holding unit illustrated in FIG. 4.

The detailed construction of the feedback control unit 640 will be first described with reference to FIG. 4. The feedback control unit 640 according to an embodiment of the present invention largely comprises a time-dividing sampling/holding unit 641, a constant current compensation circuit 643 and a time-dividing holding/output unit 645.

The time-dividing sampling/holding unit 641 performs a sampling process on the respective feedback signals F/B(1) to F/B(n), feedbacked from the plurality of LED lamps G510, G520 and G530, and holds the feedback signals F/B(1) to F/B(n).

The sampling process comprises transforming the feedback signals F/B(1) to F/B(n) into digital signals according to the predetermined time-dividing method, and assigning the sequence of a signal processing to the feedback signals F/B(1) to F/B(n).

In more detail, the time-dividing sampling/holding unit 641 comprises a switch 641_sw, a plurality of capacitors (hereinafter, referred to as a "first capacitor") 641-cap, and a plurality of buffers 641_buf, as illustrated in FIG. 5. The switch 641_sw provides a sampling start signal when on/off outputs of the feedback voltages F/B(1) to F/B(n) feedbacked from the LED lamps G510, G520 and G530 of a previous stage are switched. The first capacitor 641-cap samples the feedback voltages F/B(1) to F/B(n) received via the switch 641_sw, and stores the sampled feedback voltages F/B(1) to F/B(n). The plurality of buffers 641_buf output the sampled feedback voltages F/B(1) to F/B(n), respectively.

The time-dividing holding/output unit 645 sequentially holds voltages, compensated through the constant current compensation circuit 643, and outputs the voltages to the LED drivers 612, 622 and 632 based on time-dividing information.

The time-dividing holding/output unit 645 may also comprise a plurality of capacitors (hereinafter, referred to as a "second capacitor" (not shown)) for storing therein voltages compensated through the constant current compensation circuit 643, and a plurality of buffers (not shown) for outputting voltages compensated through the constant current compensation circuit 643 according to time-dividing information.

Figure 6:
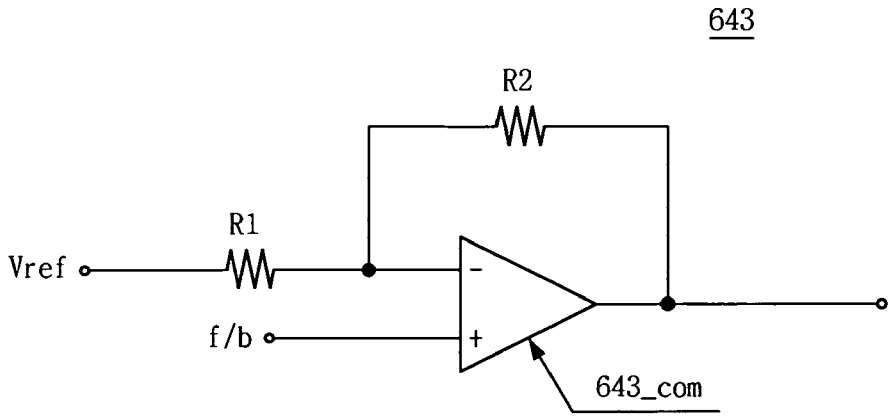
FIG. 6 is an equivalent circuit diagram schematically showing a constant current compensation circuit illustrated in FIG. 4.

FIG. 6 is an equivalent circuit diagram schematically showing a constant current compensation circuit illustrated in FIG. 4.

The equivalent circuit diagram of FIG. 6 will be described in connection with FIG. 4. The constant current compensation circuit 643 compares the feedback voltages F/B(1) to F/B(n), sampled in the time-dividing sampling/holding unit 641, with a reference value, and compensates the feedback voltages F/B(1) to F/B(n) as constant voltages suitable for constant current driving of the LED lamps G510, G520 and G530.

To this end, the constant current compensation circuit 643 may comprise a comparator 643_com and resistors R1, R2, as illustrated in FIG. 6.

The comparator 643_com consists of an operational amplifier. The operational amplifier has a + input terminal to which feedback voltages f/b feedbacked from the plurality of LED lamps G510, G520 and G530 are applied, and a − input terminal connected to one terminal of the resistor R1.

The resistor R2 is connected between the − input terminal and output terminal of the operational amplifier. A constant voltage Vref, suitable for constant current driving of each of the LED lamps G510, G520 and G530, is applied to the other terminal of the resistor R1 as a reference value.

The constant current compensation circuit 643 compares the constant voltage Vref (that is, the reference value), and the feedback voltages f/b feedbacked from the plurality of LED lamps G510, G520 and G530, and outputs the feedback voltages f/b without change when the feedback voltages f/b fall within a tolerance. However, when the feedback voltages f/b do not fall within a tolerance, the constant current compensation circuit 643 outputs the constant voltage Vref (that is, the reference value) in order to compensate for the feedback voltages f/b.

To the constant current compensation circuit 643 constructed above are input the feedback voltages f/b, which have been sampled in the time-dividing sampling/holding unit 641 of a previous stage. Accordingly, the constant current compensation circuit 643 employs a method of sequentially compensating for the feedback voltages f/b according to the sampled sequence.

The LED driving apparatus constructed above according to an embodiment of the present invention requires the feedback control unit 640 configured to control the constant current driving of the LED lamps G510, G520 and G530 in which the plurality of LEDs LED511 to LED513, LED521 to LED523, and LED531 to LED533 are grouped on a backlight-region basis. The feedback control unit 640 compensates for the constant current by supplying a high voltage necessary for the lighting of the LED lamps G510, G520 and G530 at the time of initial lighting and controlling the currents of the LED lamps G510, G520 and G530 after the lighting in order to maintain a specific brightness.

In the present embodiment, the feedback control unit 640 is integrated into one by replacing a plurality of the feedback control units 640 disposed corresponding to the plurality of LED lamps G510, G520 and G530 one by one. At the same time, the feedback voltages feedbacked from the plurality of LED lamps G510, G520 and G530 are compensated for based on time dividing and then output. Accordingly, the size and cost of the driving circuit of the LED driving apparatus can be reduced.

Figure 7:
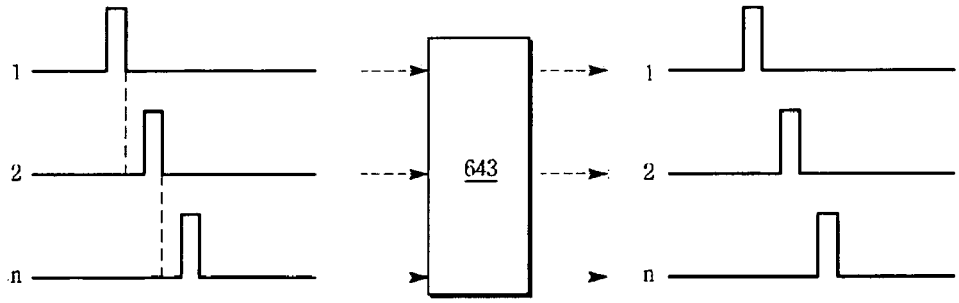
FIG. 7 is a view illustrating a signal processing procedure in a feedback control unit illustrated in FIG. 4.

FIG. 7 is a view illustrating a signal processing procedure in a feedback control unit illustrated in FIG. 4.

In FIG. 7, signal waveforms on the left side correspond to a sequence in which the feedback voltages feedbacked from the plurality of n LED lamps G510, G520 and G530 are sampled according to the time-dividing method, and signal waveforms on the right side correspond to a sequence of output signals compensated for through the feedback control unit 640.

In other words, signals feedbacked from the plurality of n LED lamps G510, G520 and G530 (that is, the feedback voltages) are sequentially sampled in the time-dividing sampling/holding unit 641 based on the time-dividing method, compensated for in the constant current compensation circuit 643 as constant currents suitable for constant current driving, and then output from the time-dividing holding/output unit 645 based on time-dividing of signals prior to compensation.

Accordingly, in the LED driving apparatus according to an embodiment of the present invention, only one feedback control unit 640 for compensating for voltages applied to the plurality of LED lamps G510, G520 and G530 can be provided without being separately provided in proportion to the respective LED lamps G510, G520 and G530.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

As described above, in accordance with the LED driving apparatus construed above and the liquid crystal display apparatus using the same according to the present invention, feedback control units for compensating for currents applied to a plurality of LEDs are integrated into one and output compensation signals based on time-dividing. Accordingly, a circuit configuration of the LED driving apparatus can be simplified, and the cost of the LED driving apparatus can be saved.

What is claimed is:

1. A Light Emitting Diode (LED) driving apparatus, comprising:

a first LED group including a plurality of LEDs connected in series;

a first constant voltage providing unit that provides constant voltages to the first LED group;

a second LED group including a plurality of LEDs connected in series;

a second constant voltage providing unit that provides constant voltages to the second LED group;

a single Pulse Width Modulation (PWM) control signal providing unit that provides a first PWM signal to the first constant voltage providing unit, and a second PWM signal to the second constant voltage providing unit; and a single feedback control unit that receives respective feedback voltages in parallel from respective outputs of the first and second LED groups, wherein the single feedback control unit comprises:

a time-dividing sampling/holding unit, wherein the time-dividing sampling/holding unit sequentially samples and holds the respective feedback voltages over a duration based on time dividing information therein;

a constant current compensation circuit comprises a comparator, wherein the comparator receives the respective sampled/held feedback voltages at a non-inverting input and a reference constant voltage with feedback gain at an inverting input, and if a voltage difference between the first and the second inputs exceeds a specified voltage range, outputs the reference constant voltage as a compensating voltage to enable constant current driving to the plurality of LEDs in the first and second constant voltage providing units; and a time-dividing holding/output unit, wherein the time-dividing holding/output unit sequentially holds and outputs the compensating voltage based on the time-dividing information;

wherein the first constant voltage providing unit comprises:

a first LED driver which controls lighting times of the first of LED group in response to the first PWM signal; and a first DC-DC converter unit electrically connected between the first LED driver and the first LED group, which is configured to boost input voltages, such that the constant voltages are provided to the first LED group, and wherein the second constant voltage providing unit comprises:

a second LED driver which controls lighting times of the second LED group in response to the second PWM signal; and a second DC-DC converter unit electrically connected between the second LED driver and the second LED group, which is configured to boost input voltages, such that the constant voltages are provided to the second LED group, wherein the time-dividing sampling/holding unit comprises:

a plurality of switches configured to be controlled by a sampling start signal to sample the respective feedback voltages, respectively;

a plurality of first capacitors configured to store the respective sampled feedback voltages; and a plurality of first buffers configured to buffer the stored respective sampled feedback voltages for output to the constant current compensation circuit.

2. The LED driving apparatus of claim 1, wherein the comparator comprises an operational amplifier.

3. The LED driving apparatus of claim 1, wherein the time-dividing holding/output unit comprises:

a plurality of second capacitors configured to sequentially store the compensating voltage based on the time-dividing information; and a plurality of second buffers configured to buffer the stored compensating voltage for output to enable constant current driving of the plurality of LEDs in the first and second constant voltage providing units, respectively, based on the time-dividing information.

4. The LED driving apparatus of claim 1, comprises a plurality of resistors connected to the output of the first and second LED groups, respectively.

5. A liquid crystal display (LCD) apparatus, comprising:

a liquid crystal panel; and a Light Emitting Diode (LED) driving apparatus that illuminates the liquid crystal panel, wherein the LED driving apparatus comprises:

a first LED group including a first plurality of LEDs connected in series that provide light to the liquid crystal panel;

a first constant voltage providing unit that provides constant voltages to the first LED group;

a second LED group including a second plurality of LEDs connected in series that provide light to the liquid crystal panel;

a second constant voltage providing unit that provides constant voltages to the second LED group;

a single Pulse Width Modulation (PWM) control signal providing unit that provides a first PWM signal to the first constant voltage providing unit, and a second PWM signal to the second constant voltage providing unit; and a single feedback control unit that receives respective feedback voltages in parallel from respective outputs of the first and second LED groups, wherein the single feedback control unit comprises: method, a time-dividing sampling/holding unit, wherein the time-dividing sampling/holding unit sequentially samples and holds the respective feedback voltages over a duration based on time dividing information therein;

a constant current compensation circuit comprises a comparator, wherein the comparator receives the respective sampled/held feedback voltages at a non-inverting input and a reference constant voltage with feedback gain at an inverting input, and if a voltage difference between the first and the second inputs exceeds a specified voltage range, outputs the reference constant voltage as a compensating voltage to enable constant current driving to the plurality of LEDs in the first and second constant voltage providing units; and a time-dividing holding/output unit, wherein the time-dividing holding/output unit sequentially holds and outputs the compensating voltage based on the time-dividing information, wherein the first constant voltage providing unit comprises:

a first LED driver which controls lighting times of the first LED group in response to the first PWM signal; and a first DC-DC converter unit electrically connected between the first LED driver and the first LED group, which is configured to boost input voltages, such that constant voltages are provided to the first LED group, and wherein the second constant voltage providing unit comprises:

a second LED driver which controls lighting times of the second LED group in response to the second PWM signal; and a second DC-DC converter unit electrically connected between the second LED driver and the second LED group, which is configured to boost input voltages, such that the constant voltages are provided to the second LED group, wherein the time-dividing sampling/holding unit comprises:

a plurality of switches configured to be controlled by a sampling start signal to sample the respective feedback voltages, respectively;

a plurality of first capacitors configured to store the respective sampled feedback voltages; and a plurality of first buffers configured to buffer the stored respective sampled feedback voltages for output to the constant current compensation circuit.

6. The liquid crystal display apparatus of claim 5, wherein the comparator comprises an operational amplifier.

7. The liquid crystal display apparatus of claim 5, wherein the time-dividing holding/output unit comprises:

a plurality of second capacitors configured to sequentially store the compensating voltage based on the time-dividing information; and a plurality of second buffers configured to buffer the stored compensating voltage for output to enable constant current driving of the plurality of LEDs in the first and second constant voltage providing units, respectively, based on the time-dividing information.

8. The liquid crystal display apparatus of claim 5, comprises a plurality of resistors connected to the output of the first and second LED groups, respectively.

* * * * *